US005675351A

United States Patent [19]

Kaneko et al.

[11] Patent Number: 5,675,351

[45] Date of Patent: Oct. 7, 1997

[54] METHOD AND APPARATUS FOR DRIVING ACTIVE MATRIX LIQUID CRYSTAL DEVICE

[75] Inventors: Shuzo Kaneko, Yokohama; Akio Yoshida, Hiratsuka; Ryoji Fujiwara, Chigasaki, all of Japan

[73] Assignee: Canon Kabushiki Kaisha, Tokyo, Japan

[21] Appl. No.: 478,096

[22] Filed: Jun. 7, 1995

Related U.S. Application Data

[63] Continuation of Ser. No. 269,906, Jul. 6, 1994, abandoned, which is a continuation of Ser. No. 66,918, May 26, 1993, abandoned, which is a continuation of Ser. No. 951,323, Sep. 25, 1992, abandoned, which is a continuation of Ser. No. 673,126, Mar. 20, 1991, abandoned.

[30] Foreign Application Priority Data

Mar. 22, 1990 [JP] Japan ..... 2-69546
Mar. 22, 1990 [JP] Japan ..... 2-69547

[51] Int. Cl.[6] ..... G09G 3/36

[52] U.S. Cl. ..... 345/87; 345/94; 345/95; 345/96; 345/97; 345/98

[58] Field of Search ..... 359/56, 84, 85, 359/59; 340/784; 345/94, 95, 96, 97, 98, 87

[56] References Cited

U.S. PATENT DOCUMENTS

| | | | |
|---|---|---|---|
| 4,048,633 | 9/1977 | Sano | 345/94 |
| 4,508,429 | 4/1985 | Nagae et al. | 345/97 |
| 4,548,476 | 10/1985 | Kaneko | 359/56 |
| 4,655,550 | 4/1987 | Crossland et al. | 359/59 X |
| 4,655,561 | 4/1987 | Kanbe et al. | 359/56 |
| 4,681,404 | 7/1987 | Okada et al. | 345/97 |
| 4,729,642 | 3/1988 | Kaneko | 359/56 |
| 4,824,218 | 4/1989 | Kuno et al. | 359/56 |
| 4,836,656 | 6/1989 | Mouri et al. | 359/56 |
| 4,840,462 | 6/1989 | Hartmann | 359/56 |
| 4,906,072 | 3/1990 | Kaneko et al. | 359/56 |
| 4,909,607 | 3/1990 | Ross | 359/56 |
| 4,932,759 | 6/1990 | Toyono et al. | 359/56 |
| 4,938,574 | 7/1990 | Kaneko et al. | 359/56 |
| 4,958,912 | 9/1990 | Inaba et al. | 359/56 |
| 4,976,515 | 12/1990 | Hartmann | 359/56 X |
| 5,014,048 | 5/1991 | Knapp | 345/94 |
| 5,091,723 | 2/1992 | Kanno et al. | 345/94 |
| 5,440,412 | 8/1995 | Mouri et al. | 345/97 |

FOREIGN PATENT DOCUMENTS

| | | |
|---|---|---|
| 2544884 | 10/1994 | France . |
| 63-235919 | 9/1988 | Japan . |
| 63-253333 | 10/1988 | Japan . |

OTHER PUBLICATIONS

Hartmann, "Ferroelectric Liquid–Crystal Video Display", IEEE, Proceedings of the SID, vol. 30, No. 2, 1989, pp. 99–103.

*Primary Examiner*—Richard Hjerpe
*Assistant Examiner*—Joseph Acosta
*Attorney, Agent, or Firm*—Fitzpatrick, Cella, Harper & Scinto

[57] ABSTRACT

An active matrix liquid crystal device is driven by sequentially applying a first scanning pulse to reset each pixel on a first selected line, a second scanning pulse to write each pixel on a second selected line and a third scanning pulse to provide a voltage signal which is equal to or less than the optical threshold value of the liquid crystal to each pixel on a third selected line. According to the driving method, the first, second and third selected lines are spaced at a predetermined number of lines from each other, and a sum of time integrated values of the applied voltage signals is or approaches zero.

13 Claims, 10 Drawing Sheets

METHOD AND APPARATUS FOR DRIVING ACTIVE MATRIX LIQUID CRYSTAL DEVICE

This application is a continuation of application Ser. No. 08/269,906, filed Jul. 6, 1994, now abandoned which is a continuation of application Ser. No. 08/066,918, filed May 26, 1993, now abandoned which is a continuation of application Ser. No. 07/951,323, filed Sep. 25, 1992, now abandoned which is a continuation of application Ser. No. 07/673,126, filed Mar. 20, 1991, now abandoned.

BACKGROUND OF THE INVENTION

1. Field of the Invention

The present invention relates to method and apparatus for driving an active matrix liquid crystal device in which a liquid crystal display device having a memory performance is driven by an active matrix device.

2. Related Background Art

Hitherto, a liquid crystal display device having an active matrix device has widely been applied to the case of using a TN liquid crystal and has been put into practical use as a flat panel display or a projection television as an article of commerce. The active matrix device represented by a thin film transistor (TFT), a diode device, an MIM (metal insulator metal) device, or the like assists an optical switching response of a liquid crystal by holding a voltage applied state for a period of time longer than a substantial line selection period of time for the TN liquid crystal of a relatively slow response speed by switching characteristics of the active matrix device. On the other hand, the active matrix device provides a substantial memory state in one frame period of time by the holding of the voltage applied state mentioned above for a liquid crystal having no memory performance (self holding property) such as a TN liquid crystal or the like. The active matrix device provides a good display screen without crosstalk between lines or between pixels in principle. FIG. 10 shows the structure of an active matrix liquid crystal device as a liquid crystal display device having such an active matrix device.

In recent years, the development of a ferroelectric liquid crystal (FLC) having a response speed which is higher than that of the above TN liquid crystal by a few orders of magnitude has progressed. A display panel, a light bulb, or the like using the FLC have also been proposed. There is a possibility that even better display quality can be obtained by driving the FLC by the active matrix device. A device comprising a combination of the FLC and the TFT has characteristics as shown in, for instance, U.S. Pat. No. 4,840,462, the publication "Ferroelectric Liquid Crystal Video Display", Proceedings of the SID, Vol. 30/2, 1989, or the like.

On the other hand, in the case of driving a liquid crystal, there are problems such that the liquid crystal deteriorates due to the accumulation of DC components for a long time and that, in the case of the FLC, there occurs a response abnormality such that bistability is lost and the liquid crystal becomes monostable, and the like. Endeavors to improve a material, a driving method, and the like of the TN liquid crystal have been executed for a long time and the above problems were slightly reduced. However, in the FLC having advantages such as high response speed, memory performance, and the like, the essential problem which occurs because the material has spontaneous polarization still exists.

The above problems also similarly exist in the case of driving the liquid crystal by an active matrix device such as a TFT or the like.

For instance, according to the driving method in the active matrix of the FLC shown in each of the above publications, for the FLC having no threshold value in a direct current manner, the applied voltage acting on each pixel does not allow the DC component to have a large effect on the material due to a reset pulse and a recording pulse. However, for the FLC cell having a threshold value in a DC manner for polarization inversion, the DC component of the threshold voltage or lower due to the holding of a recording voltage after a recording pulse was applied cannot be avoided.

Thus, for such a material, there the a possibility of the occurrence of problems such that the display quality deteriorates and the like.

SUMMARY OF THE INVENTION

The present invention is made in consideration of the above problems and it is an object of the invention to provide a display device for use in, particularly, high definition TV or the like which requires high accuracy and a high driving speed.

Another object of the invention is to provide a method and apparatus for driving an active matrix liquid crystal display which can be applied to a display device which requires high accuracy and a high driving speed.

Still another object of the invention is to provide a method of driving an active matrix liquid crystal device, in which pixels of the liquid crystal display device having a memory performance are sequentially driven by an active matrix device, wherein after the recording signal voltage is applied to each pixel to determine an optical state of a liquid crystal of the pixel a grounding signal is applied after a predetermined time.

BRIEF DESCRIPTION OF THE DRAWINGS

FIGS. 2 and 3A-1 to 3C-4 are schematic diagrams for explaining an optical state of an FLC which is driven at timings shown in FIG. 1;

FIG. 4 is a timing chart for explaining in more detail an example of an FLC driving voltage;

FIGS. 6A-1 to 6C-4 are schematic diagrams for explaining an Optical state of the FLC which is driven at the timings shown in FIG. 5;

DETAILED DESCRIPTION OF THE PREFERRED EMBODIMENTS

Figure 1:
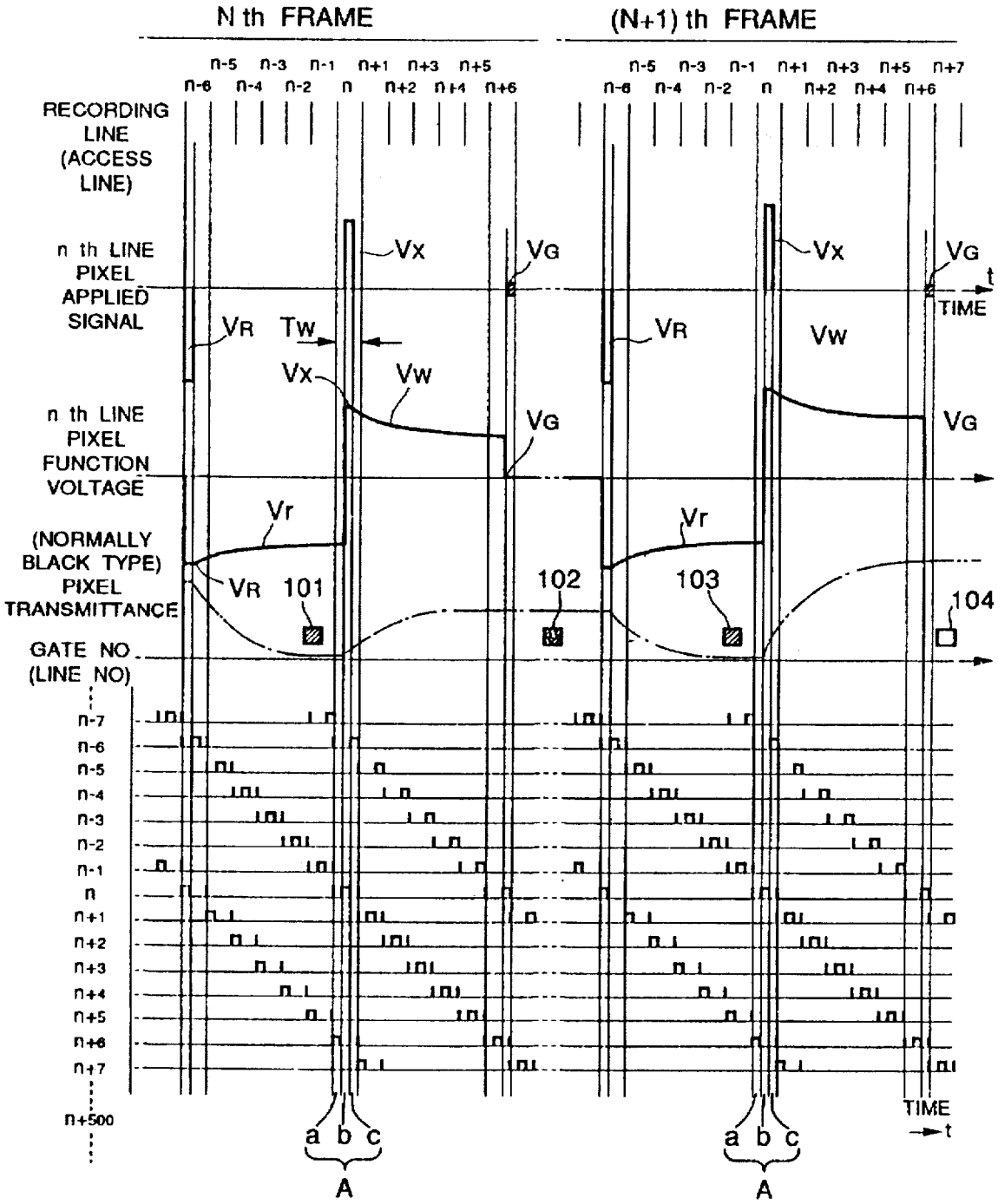
FIG. 1 is a timing chart showing an FLC driving method according to an embodiment of the present invention.

A preferred embodiment of a driving method of an active matrix liquid crystal device according to the invention will be described hereinbelow.

According to the invention, there is provided a method of driving an active matrix liquid crystal device, in which pixels of the liquid crystal display device having a memory performance are sequentially driven by an active matrix device, wherein after a recording signal voltage is applied to each pixel to determine an optical state of a liquid crystal of the pixel, a grounding signal is applied after a predetermined time.

According to the invention, there is also provided a method of driving an active matrix liquid crystal device, in which pixels of a liquid crystal display device having a memory performance are line sequentially driven by an active matrix device, wherein upon access of the pixels of each particular line of the liquid crystal display device for recording, at least a recording signal is applied to each pixel of the particular line, then a reset voltage to reset each pixel of the other lines or the particular line is applied, and then a grounding signal is applied to each pixel of the other lines or the particular line.

According to the invention, there is further provided a method of driving an active matrix liquid crystal display device, in which the liquid crystal display device having a memory performance is driven by an active matrix device, wherein first a recording signal voltage is applied to each pixel to decide an optical state of a liquid crystal of the pixel, and then, an auxiliary signal comprising a voltage signal whose level is equal to or less than an optical threshold value of the liquid crystal is applied after a predetermined time.

According to the invention, there is further provided a method of driving an active matrix liquid crystal device, in which the liquid crystal display device having a memory performance is line sequentially driven by an active matrix device, wherein upon recording access timings of pixels of each particular line of the liquid crystal display device, there are provided at least, a reset signal applying interval to apply a voltage to reset each pixel of the other lines or the particular line, a recording signal applying interval to apply a voltage to record information into each pixel of the particular line, and an auxiliary signal applying interval to apply a voltage whose level is equal to or less than an optical threshold value of the liquid crystal to each pixel of the other lines or the particular line.

A preferred embodiment of an apparatus for driving an active matrix liquid crystal device according to the invention will now be described hereinbelow.

According to the invention, there is provided an apparatus for driving an active matrix liquid crystal device, in which the liquid crystal display device having a memory performance is driven by an active matrix device, wherein the apparatus has voltage output means for adjusting and outputting an auxiliary signal corresponding to an image recording signal so that the sum the time integrated values the voltages which are applied to pixels is equal to almost 0.

According to the driving method of the invention, a good active matrix liquid crystal display having a long life and in which the picture quality does not deteriorate can be provided. Thus, a direct viewing type flat display or a projection television of high accuracy can be realized. In addition, a highly accurate flat color television or projection color television of the transmission type or reflection type can be also constructed by a method whereby a color filter is provided for every pixel or a plurality of liquid crystal devices using the driving method of the invention are used and a color light projection is executed for each of the liquid crystal devices.

A liquid crystal to which the driving method of the invention is applied is made of a light modulation material having at least two stable states. More particularly, the material is set to either one of first and second optical stable states in accordance with an applied electric field, that is, the material has bistable states in response to an electric field.

As such a liquid crystal, a chiral smectic liquid crystal having a ferroelectric property is preferable. A chiral smectic liquid crystal of chiral smectic C phase (SmC*) or H phase (SmH*), or further, SmI*, SmF*, SmG*, or the like is suitable. According to the invention, a sufficient effect as will be explained hereinlater is obtained even in the case of using other liquid crystals having memory performance. On the other hand, those liquid crystals can be also used by executing temperature control or the like to them.

The invention will now be described in detail hereinbelow on the basis of preferred embodiments.

[Embodiment 1]

FIG. 1 is a timing chart showing an FLC driving method according to an embodiment of the invention.

In the invention according to the embodiment, FIG. 1 shows the switching characteristics of a TFT. That is, the characteristics across a cell to hold a recording voltage signal $V_x$ applied to a pixel (liquid crystal) as a recording voltage (function voltage) $V_w$ are held for a time which is necessary cause an optical state change of the pixel. After that, by temporarily switching the voltage across the cell to (ideally) an earth or grounding voltage (voltage =0) state, the recording voltage $V_w$ is presented from being supplied for too long a time and a reset voltage $V_r$ is supplied, thereby reducing the DC offset.

Assuming that all of the state changes of the liquid crystal occur within the applying time of the reset voltage $V_r$, fundamentally, it is sufficient to set the applying time of the recording voltage $V_w$ to be almost equal to the applying time of the reset voltage. Since the liquid crystal which is used in the invention has the memory performance, even if the voltage across the upper and lower electrodes of the pixel has been set to 0 as mentioned above, the optical state is maintained by the memory performance of the liquid crystal itself.

To allow the above driving method to effectively function, a recording interval between lines is divided into at least three intervals. In FIG. 1, a timing chart located in the lower portion shows an example where a recording interval A of the nth line has been divided into three intervals. That is, the recording interval A for the nth line is divided into: a first interval a for resetting the corresponding pixel a few lines (six lines in FIG. 1) subsequent thereto and for opening a gate of the subsequent line (i.e., n+6); a second interval b for recording the nth line itself and for opening a gate of the nth line; and a third interval c for setting a voltage to 0 for a recording pixel of a few preceding lines (six lines in FIG. 1) and for again opening the gate of the preceding line (i.e., n−6 ). Within the recording interval A of the nth line, the order of the intervals a, b, and c can be freely set to any one of the possible following orders: abc, acb, bac, bca, cab, and cba.

In FIG. 1, reference numerals 101 to 104 denote optical states of liquid crystals of certain pixels of the nth line. The above optical states are enlargedly shown in FIGS. 2 and 3 and will now be explained.

Figure 2:
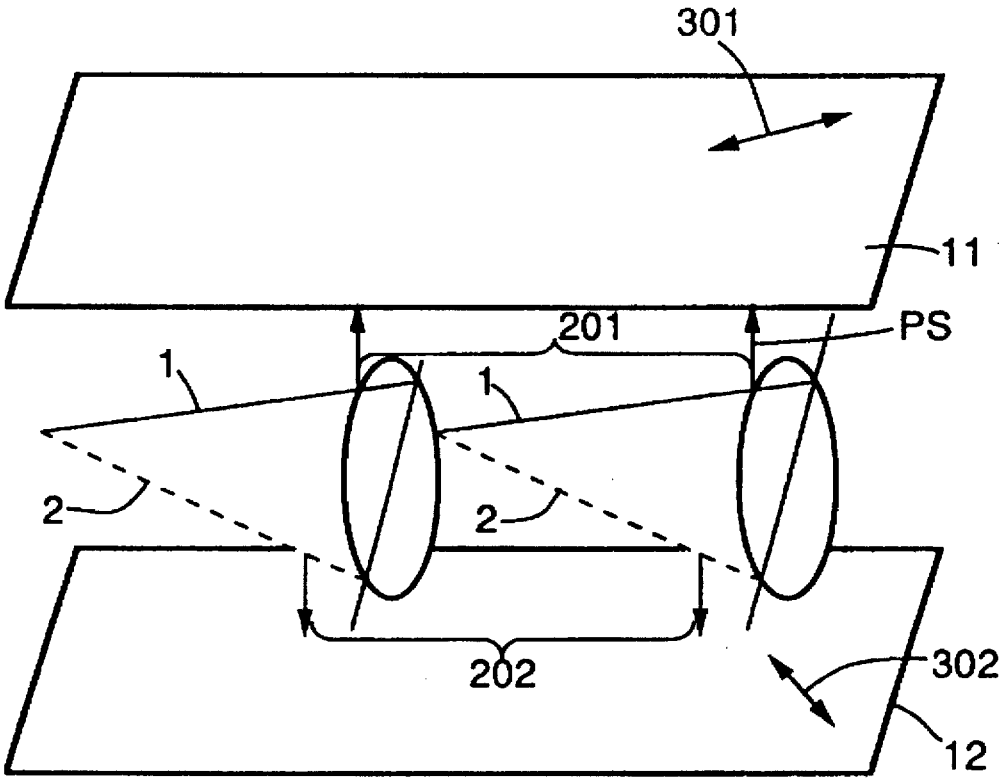
Figures 1, 3A:
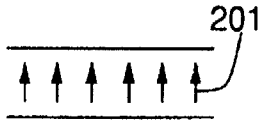
Figures 2, 3A:
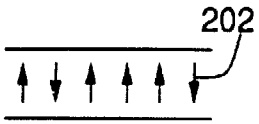
Figures 3, 3A:
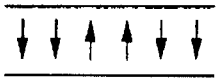

FIG. 2 sows a schematic diagram of an FLC sandwiched between an upper electrode substrate 11 on which a TFT active matrix is formed and a lower substrate 12 on which an electrode is formed on a whole surface. The FLC has a principle such that in the case where a direction of spontaneous polarization $P_s$ upward (201), a major axis of an FLC molecule is set to a direction of a solid line 1 and that in the case where it is downward (202), the major axis of the FLC molecule is set to a direction of a broken line 2. In reset intervals R shown with reference to FIGS. 3C-1 to 3C-4, when the voltage of the upper electrode is held to a negative voltage, all of the spontaneous polarizations in the reset intervals are ideally set to the upward (201) state. When either one of polarizing plates 301 and 302 provided separately due to the relation of a cross polarizer is set so as to coincide with one direction of the major axes shown by solid lines, the pixel is set to "black". In FIG. 3B-1 shows such a "black" state.

By subsequently applying a desired gradient voltage $V_w$ to record in recording intervals W, the pixel is set into a recording state according to the gradient voltage $V_w$. That is, if the gradient voltage $V_w$ is equal to or larger than a threshold voltage which changes the optical state of the liquid crystal, "white" domains as shown in FIGS. 3B-2 to 3B-4 are generated. On the contrary, if the gradient voltage $V_w$ is lower than the threshold value, the "black" state in FIG. 3B-1 is held. After that, even if the upper and lower electrodes are temporarily short-circuited by the TFT device and the voltage across the electrodes is set to 0, the recording state is maintained in the case of the FLC having the memory performance.

Therefore, when summarizing an example of the invention by returning to FIG. 1, the recording state is set by applying the reset voltage $V_r$ and recording voltage $V_w$ of different polarities for almost the same time. Moreover, since the optical state in one frame period of time is held by using the memory performance of the liquid crystal itself, the problem of deterioration of the display quality due to the DC offset is also largely improved.

For instance, in the television display which can cope with what is called a recent high vision system, in the case of driving about 1000 scanning lines in a non-interlacing manner, they are driven for about 30 msec per frame.

Therefore, the recording time which is assigned to one line in one frame is set to about 30 μsec. In the invention, an interval of 30 μsec for the recording of the nth line is divided into three intervals (each interval is set to about 10 μsec). For instance, it is divided into: a pulse applying interval to reset the line pixels which are recorded after six lines; a recording pulse interval to record the pixels of the nth line itself; and a 0 voltage applying interval to set the voltage to almost 0 for the line pixels which have been recorded in the line of six preceding lines. Each of the voltage applying times for resetting and recording is equal to about 6×30 μsec=180 μsec. For the material used by the inventors of the present invention, an adequate image display was obtained by applying a driving pulse voltage of up to about 7 V. Further, since the DC offset hardly exists, as compared with the case of driving the FLC by the conventional TFT driving method in which the 0 voltage applying interval is not provided, the problems such that the device becomes monostable with the elapse of time and an unnecessary electrode reaction occurs and the like were remarkably improved.

On the other hand, since the applied voltage of 0 V results in a signal to electrically reset a residual charge state when it was recorded in the preceding frame, an electrical influence on the next recording state by the preceding state is reduced and the stable display can be realized.

[Embodiment 2]

Another embodiment of the invention will now be described.

Figure 5:
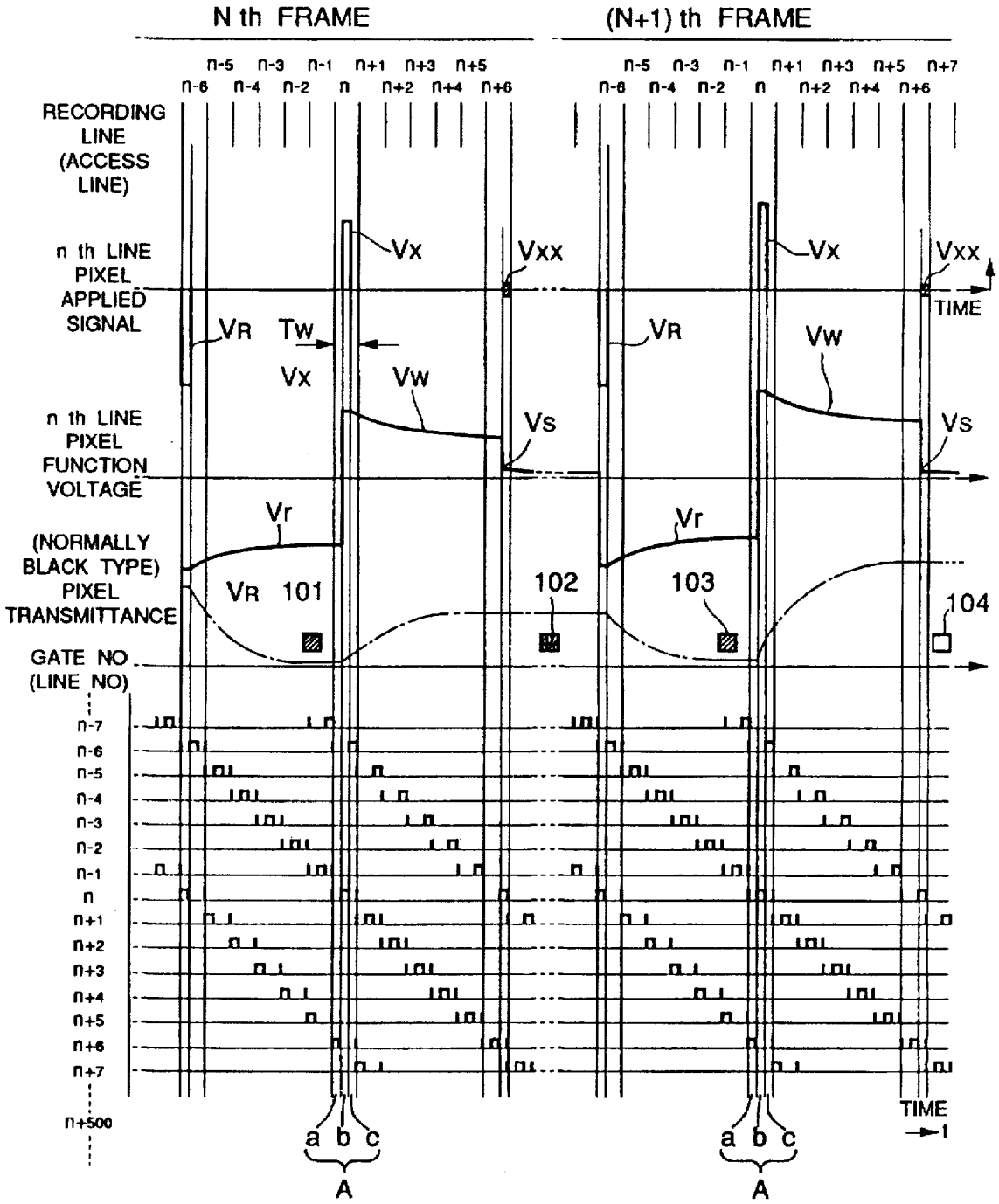
FIG. 5 is a timing chart showing an FLC driving method according to another embodiment of the invention.

FIG. 5 is a timing chart showing an FLC driving method according to another embodiment of the invention.

According to the invention shown in the embodiment, as shown in FIG. 5, switching characteristics of the TFT, that is, opening characteristics across a cell to hold the recording voltage signal $V_x$ applied to the pixel (liquid crystal) as a recording voltage (function voltage) $V_w$ are held for a time which is necessary to change an optical state of the pixel. After that, an auxiliary voltage $V_s$ ($V_{xx}$ as an auxiliary voltage signal) is adjusted and given so that the sum of the time integrated values of the reset voltage $V_r$, recording voltage $V_w$, and auxiliary voltage $V_s$ is equal to almost 0, thereby eliminating the DC component for a whole frame in principle irrespective of the magnitude of the recording voltage $V_w$.

The recording voltage $V_w$ and recording voltage signal $V_x$ are the signals to determine the optical state of the pixel and are the voltage (gradient voltage) corresponding to display luminance of the pixel and its signal. On the other hand, as an auxiliary voltage $V_s$ and an auxiliary voltage signal $V_{xx}$, a DC voltage whose level is equal to or less than an optical threshold value $V_{th}$ as a maximum voltage whose absolute value lies within a range such as not to change the optical state of the liquid crystal is applied.

Assuming that all of the state changes of the liquid crystal occur within the applying time of the reset voltage $V_r$, it is fundamentally sufficient to set the applying time of the recording voltage $V_w$ to be almost equal to the applying time of the reset voltage.

Since the liquid crystal which is used in the invention has the memory performance, even in a state in which the auxiliary voltage $V_s$ which is equal to or less than the threshold value $V_{th}$ has been applied as mentioned above, the optical state is maintained by the memory performance of the liquid crystal itself.

To allow the above driving method to effectively function, the recording interval of each line is divided into at least three intervals. In FIG. 5, a timing chart locating in the lower portion shows an example in the case where the recording interval A of the nth line has been divided into three intervals. That is, the recording interval A is divided into: the dividing interval a for resetting the pixels of a few lines after and for opening the gate of the line corresponding to the line of the few lines after; the dividing interval b for recording the nth line itself and for opening the gate of the nth line; and a dividing interval c for giving an auxiliary voltage to the recording pixels of a few preceding lines and for opening the gate of the line corresponding to the line of the few preceding lines. In the recording interval A of the nth line, the order of the dividing intervals a, b, and c can be arbitrarily set to any one of the orders of abc, acb, bac, bca, cab, and cba.

In FIG. 5, reference numerals 101 to 104 denote the optical states of the liquid crystals of certain pixels on the nth line.

The above optical states are enlargedly shown in FIGS. 6A-1 to 6C-4 and will now be described. The explanation regarding FIG. 2 mentioned above shall also apply to the embodiment.

Figures 3, 3A, 4:
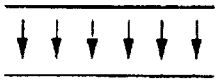
Figures 1, 3B:
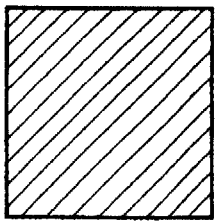
Figures 2, 3B:
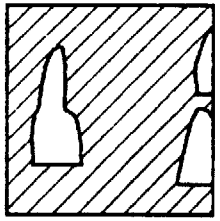
Figures 3, 3B:
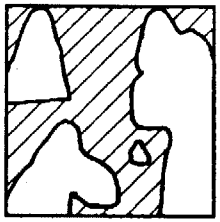
Figures 3, 3B, 4:
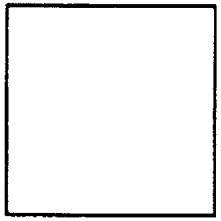
Figures 1, 3C:
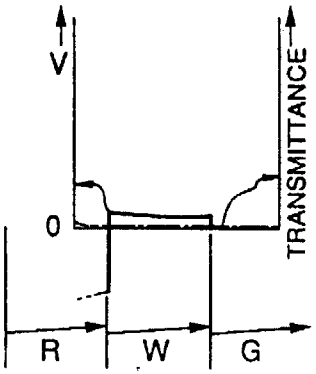
Figures 2, 3C:
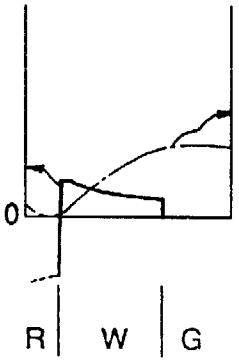
Figures 3, 3C:
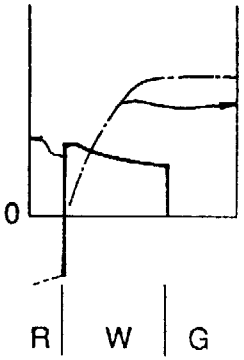
Figures 3, 3C, 4:
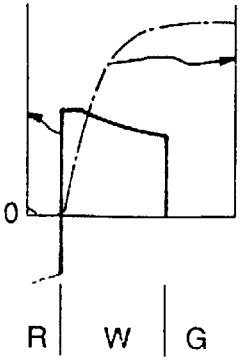
Figure 4:
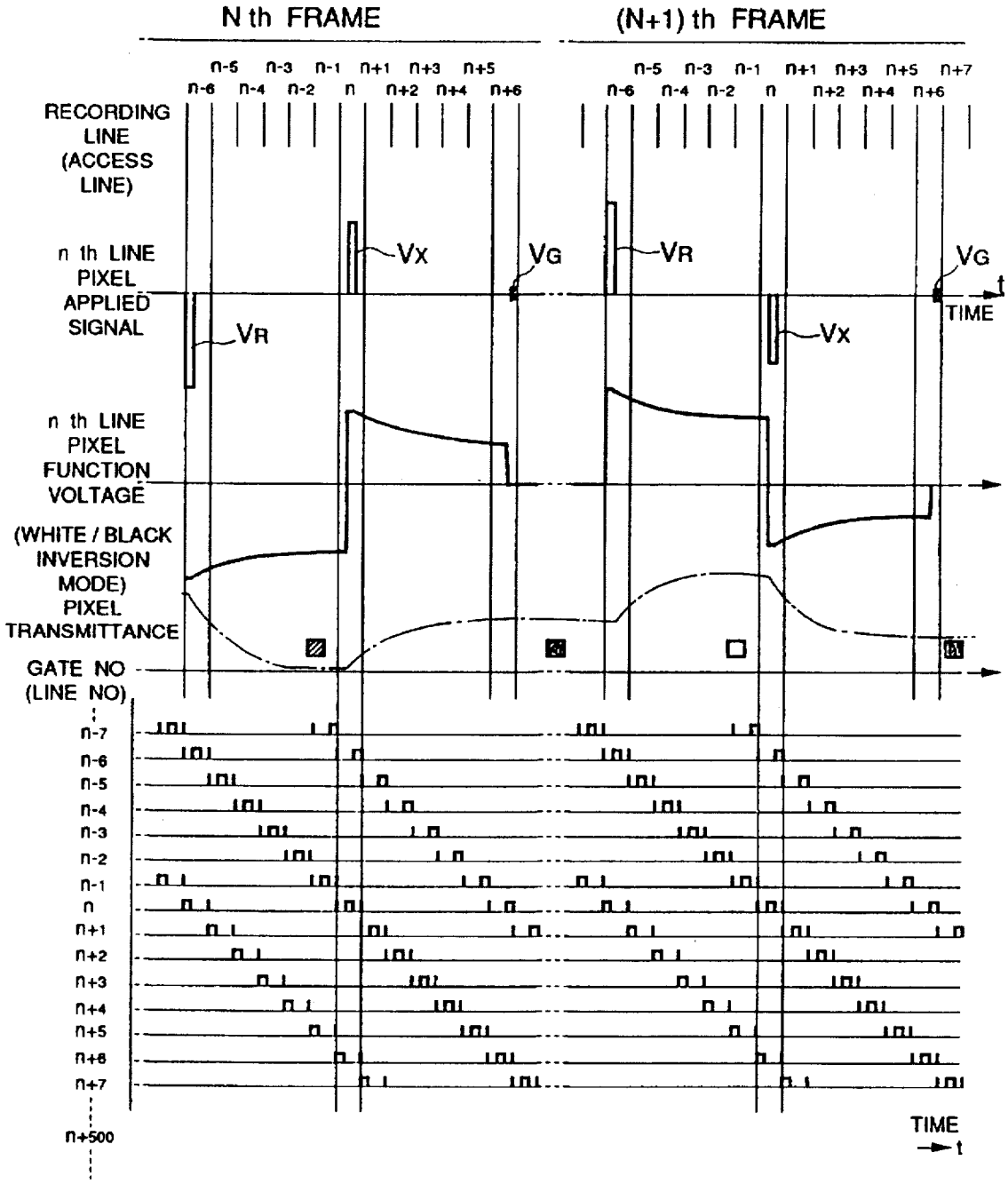
Figures 1, 6A:
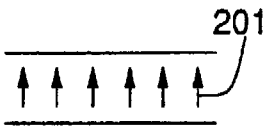
Figures 2, 6A:
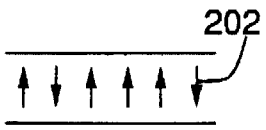
Figures 3, 6A:
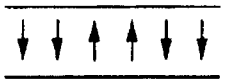
Figures 4, 6A:
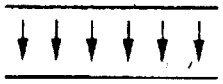
Figures 1, 6B:
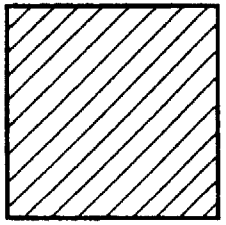
Figures 2, 6B:
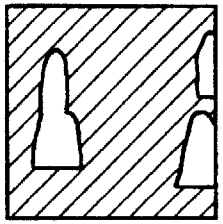
Figures 3, 6B:
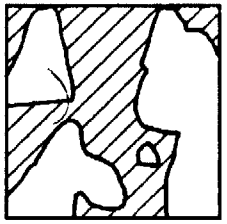
Figures 4, 6B:
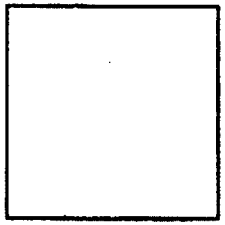
Figures 1, 6C:
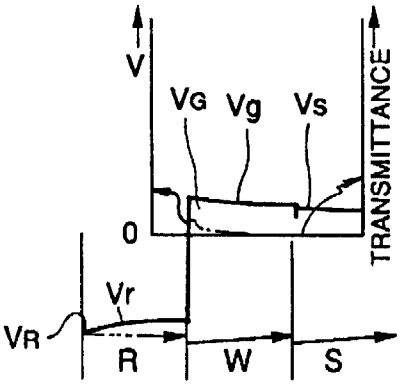
Figures 2, 6C:
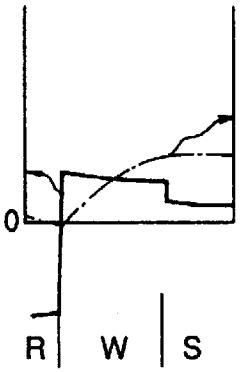
Figures 3, 6C:
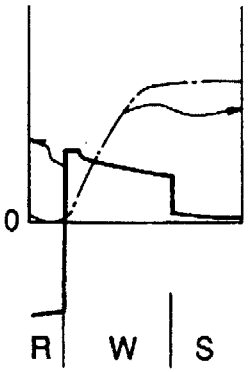
Figures 4, 6C:
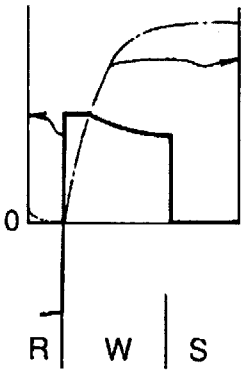

In the reset intervals R shown in FIGS. 6C-1 to 6C-4, if the voltage of the upper electrode 11 shown in FIG. 2 is held to a negative value, all of the spontaneous polarizations in the reset intervals R are ideally set into the upward (201) state. When either one of the polarizing plates 301 and 302 separately provided due to the relation of the cross polarizer is set so as to coincide with one direction of the major axes shown by solid lines, the pixel is set into "black". FIG. 6B-1 shows such a "black" state.

By subsequently applying a desired gradient voltage $V_w$ for recording in the recording interval w, the pixel is set into a recording state corresponding to the gradient voltage $V_w$. That is, if the gradient voltage $V_w$ is larger than the optical threshold value $V_{th}$, "white" domains as shown in FIGS. 6B-2 to 6B-4 are generated. On the contrary, if the gradient voltage $V_w$ is equal to or lower than the threshold value $V_{th}$, the "black" state shown in FIG. 6B-1 is held. Even if a voltage which is equal to or less than the threshold value $V_{th}$ is subsequently applied in the auxiliary voltage interval S, the recording state is maintained in the case of the FLC having the memory performance. It is sufficient to set the optical threshold value $V_{th}$ of the liquid crystal to a DC voltage value such as not to change a transmitting state of the pixel (optical state of the liquid crystal of the pixel) when a DC voltage of a pulse length which is almost equal to one frame length (about 30 msec) has been applied in the case of, for example a TV signal.

When an example of the invention is summarized by returning to FIG. 5, therefore, by applying the reset voltage $V_r$ and the recording voltage $V_w$ having different polarities for almost the same time, the recording state is determined. Moreover, even if the auxiliary voltage $V_s$ whose level is decided by the recording voltage $V_w$ is applied, the optical state for one frame period of time is held by using the memory performance of the liquid crystal itself. Consequently, even if any recording signal is applied, the DC voltage component can be eliminated and the good display quality is always held.

For instance, in the television display which can cope with what is called recent high vision system, in the case of driving about 1000 scanning lines in a non-interlacing manner, they are driven for about 30 msec per frame. Therefore, the recording time which is assigned per line is equal to about 30 μsec per frame. In the invention, the interval of 30 μsec for the recording of the nth line is divided into three intervals (each interval is set to be equal to or less than 10 μsec). For instance, it is divided into: a pulse applying interval to reset the pixels of the line which are recorded after six lines; a recording pulse interval to record the pixels of the nth line itself; and an auxiliary signal applying interval to give an auxiliary voltage to the pixels of the line which have been recorded at the line of six preceding lines. Each of the voltage applying times for resetting and recording is equal to about 6×30 μsec=180 μsec. For the material used by the inventors of the present invention, an adequate image display was obtained by applying a driving pulse voltage of up to about 7 V. Further, since the DC component is eliminated by applying the auxiliary voltage, as compared with the case where the FLC is driven by the conventional TFT driving method, the problems such that the device becomes monostable with the elapse of time and an unnecessary electrode reaction occurs and the like were improved.

Figure 7:
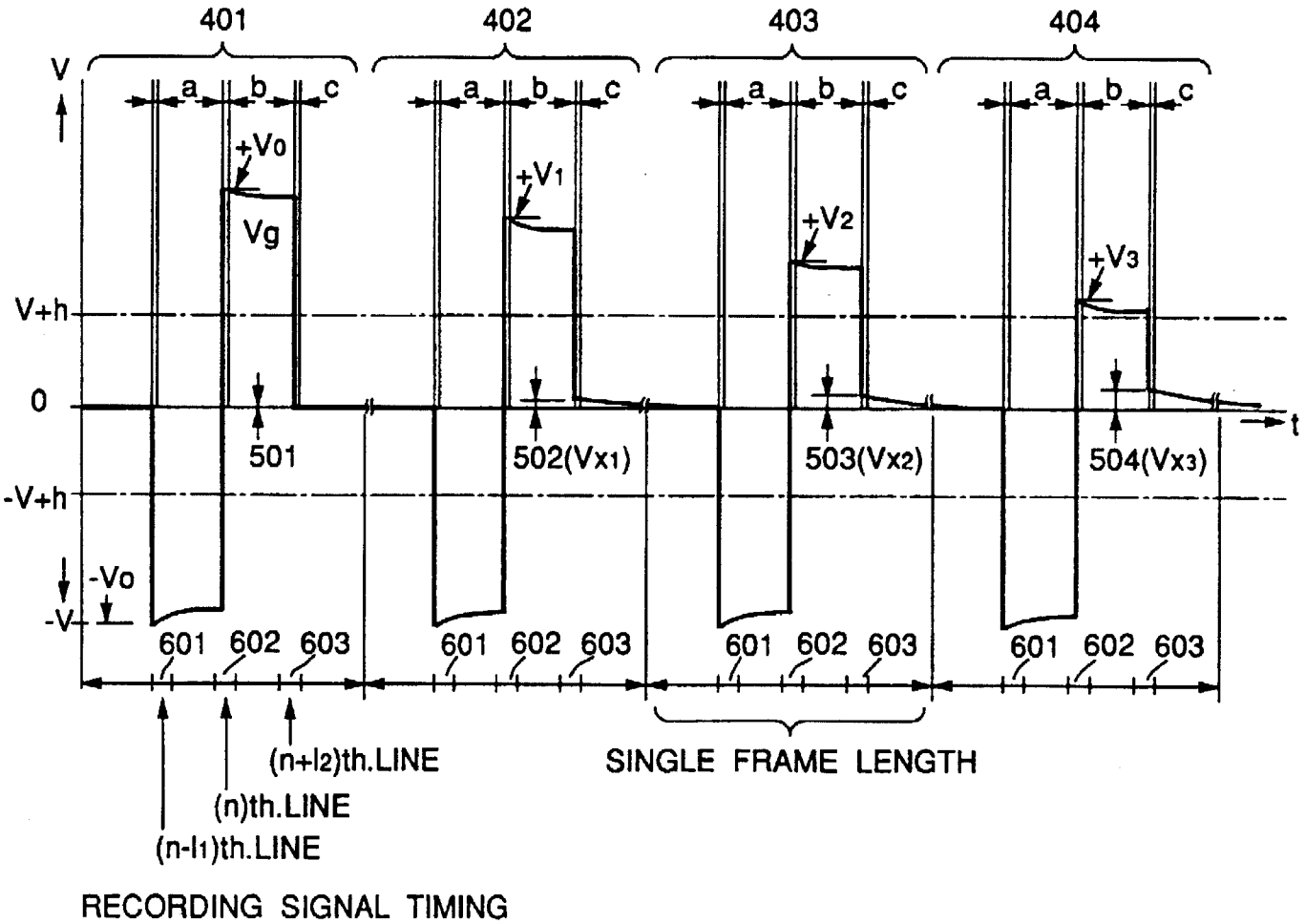
FIG. 7 is a timing chart for explaining in more detail another example of the FLC driving voltage.

The driving method shown in FIG. 5 will now be described further in detail with reference to FIG. 7.

A peak value of the pulse of the auxiliary voltage signal $V_{xx}$ is obtained in the following manner as an example.

Now, assuming that a peak value $V_R$ of the reset voltage $V_r$ in the reset signal interval a is equal to $-V_0$ as an ideal voltage waveform, when a peak value $V_x$ of the recording voltage $V_w$ in the recording signal interval b is equal to $+V_0$, it is sufficient that a peak value $V_{xx}$ of the auxiliary voltage $V_s$ in the auxiliary signal interval c is set to ±0 (interval 401) so long as those voltage applying times are equal.

On the other hand, in the case of giving gradients to the recording signal as shown in intervals 402, 403, and 404, the time integrated values of the voltages which are applied to the pixel can be set to almost 0 by approximately setting peak values $V_{x1}$, $V_{x2}$ and $V_{x3}$ of the auxiliary voltages which are applied in the invention as follows $$V_{x1} = \frac{(V_0 - V_1) \times l}{1024 - (2l + 1)}$$

-continued $$V_{x2} = \frac{(V_0 - V_2) \times l}{1024 - (2l + 1)}$$

$$V_{x3} = \frac{(V_0 - V_3) \times l}{1024 - (2l + 1)}$$

under the conditions such that the number of scanning lines is set to 1000, a frame interval is set to a time corresponding to 24 lines, a reset period is set to a time of $l_1$ lines, a recording period is set to a time of l lines, a delay timing $l_2$ to apply the auxiliary signal and $l_1=l_2=l$.

In the case where the number $l_1$ of preceding lines to apply the reset signal differs from the delay timing $l_2$ to apply the auxiliary signal, the peak values $V_{x1}$, $V_{x2}$, and $V_{x3}$ of the auxiliary voltages for the above periods of time are set as follows within a range of the DC-manner threshold value or less of the liquid crystal.

$$V_{x1} = \frac{(V_0 \times l_1) - (V_1 \times l_2)}{1024 - (l_1 + l_2 + 1)}$$

$$V_{x2} = \frac{(V_0 \times l_1) - (V_2 \times l_2)}{1024 - (l_1 + l_2 + 1)}$$

$$V_{x3} = \frac{(V_0 \times l_1) - (V_3 \times l_2)}{1024 - (l_1 + l_2 + 1)}$$

When $l_1<l_2$, the auxiliary voltages can be also set to minus voltage values.

As practical numerical values, a reset voltage (whole "black" voltage) of the bistable liquid crystal which is used is set to $-V_0=-7$ (V), a maximum gradient voltage (whole "white" voltage) is set to $V_0=7$ (V), and $l_1=l_2=l=6$. Assuming that the gradient voltage $V_x$ is equal to 5 V as a half tone, the auxiliary voltage $V_{xx}$ is set to $$V_{xx} = \frac{(7-5) \times 6}{1024 - 13} = \frac{12}{1011} \simeq 11.9 \text{ (mv)}$$

The auxiliary voltage $V_{xx}$ can be also calculated by the analog recording signal voltage $V_x$ at this state. If the recording signal voltage $V_x$ has a digital value, it can be also automatically generated from a table T ($V_x$, $V_{xx}$) which has previously been stored.

The driving method of the invention can be easily accomplished by providing line memories of at least $l_2$ lines.

That is, since the delay time of $l_2=6$ lines exists for a period of time from a time point of the generation of the recording signal to a time point of the generation of the auxiliary signal in the above case, it is necessary to store the information of $l_2=6$ lines for the generation of the recording signal of the other line during such a delay time.

Figure 8:
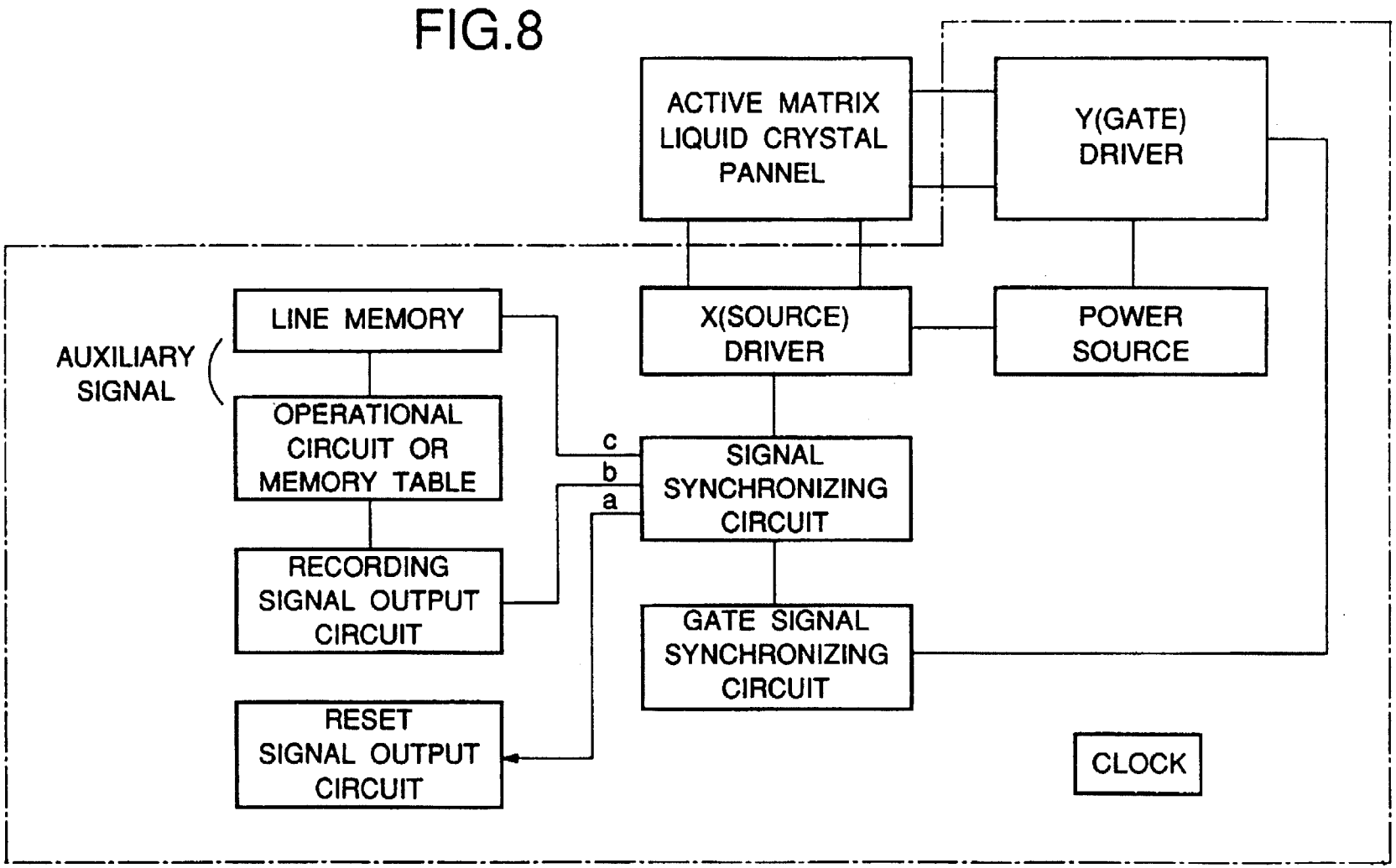
FIG. 8 is a block diagram of a driving circuit according to an embodiment of the invention.

FIG. 8 shows an example of a simple block diagram of a driving circuit. All of the synchronizing processes of the signals are executed on the basis of clocks shown in the diagram. Gate signal output timings to the lines and the output timings of the reset signal, recording signal, and auxiliary signal to a source electrode are controlled, thereby executing the signal synchronization.

It will be understood that a better effect of the supply of the auxiliary voltage of the invention is derived by a combination of the liquid crystal having the memory performance and the active matrix device.

[Embodiment 3]

FIG. 4 shows a driving waveform according to an embodiment of the invention. In the embodiment, the resetting conditions are changed to black, white, black, white, .

. . every frame (namely, . . . . the Nth frame, the (N+1)th frame, . . . ). By such a method, the DC component can be fundamentally further reduced. Moreover, by recording "white" for the resetting condition "black", by recording "black" for the resetting condition "white", and by providing a voltage applying interval to set the voltage across the cell to almost 0 after the elapse of the recording voltage applying time which is nearly equal to the time when the reset voltage is substantailly applied in a manner similar to the embodiment shown in FIG. 1, the deterioration of the picture quality due to an unnecessary electrode reaction or the like can be prevented in a manner similar to the foregoing example.

According to the method of the embodiment as well, a period of time to generate each of the reset pulse, recording pulse, and 0 voltage pulse signal is set to about 10 μsec in a manner similar to the foregoing driving method. The reset pulse is given to the pixels of the recording line of six lines after. The 0 voltage pulse is given to the pixels of the lines which have been recorded on the line of six preceding lines. Due to this, the resetting and recording operations can be accomplished by applying a voltage of up to about 7 V.

In the foregoing embodiments 1 and 3, a line interval to apply each of the reset pulse and the 0 voltage pulse to the line of six preceding lines or the line of six lines after can be properly selected in accordance with a response speed of the material of the liquid crystal which is used. However, it is preferable to reduce such a line interval to a value near the upper limit of the response speed of the material so as not to cause a flicker or the like on the screen.

On the other hand, in the case where the maximum values of the reset voltage, recording voltage, and the like are changed for adjustment or the like of, for example, the whole "white" or whole "black" state or the like, even if the reset voltage applying time, the recording voltage applying time, and the like are set so as to differ in both of the signal pulse and the substantial cell holding time, an effect similar to that mentioned above is not lost.

Further, in the case of using a liquid crystal material having a further high response speed, a reset voltage applying interval of the Nth line or a 0 voltage applying interval can be also provided in the recording interval of the pixels of the Nth line. In this case, even if each signal pulse which is sufficiently smaller than the time which is necessary to access one line is used, the sum of the voltage applying times can be increased to the time width which is required to access one line due to the switching effect of the TFT.

It will be easily understood that according to the invention, a similar effect can be obtained even in the case of the non-interlacing scanning driving method as mentioned above and the conventional well-known interlacing scanning driving method.

[Embodiment 4]

In the embodiment 2, after the positive or negative auxiliary signal was applied to the pixels of a certain line, the positive or negative auxiliary voltage is applied for one frame period of time by the opening characteristics of the active matrix, that is, by the voltage holding characteristics to the FLC. In this case, the auxiliary voltage applying interval is extremely longer than the resetting and recording voltage applying intervals and the peak value of the auxiliary voltage is extremely small, so that there is a case where it is difficult to control the auxiliary voltage.

In the invention, further, by slightly increasing the peak value $V_{xx}$ of the auxiliary voltage, $V_{xx}$ can be easily controlled as will be explained hereinafter.

In the embodiment, by further providing a 0 voltage applying interval into the auxiliary signal interval, the peak value of the auxiliary voltage is set to a value within a range of a threshold value or less such that it can be easily controlled. Assuming that the 0 voltage applying interval is provided after further $l_3$ lines after the auxiliary signal input, the value of $V_{xx}$ can be set to $$V_{xx} = \frac{(V_0 \times l_1) - (V_x \times l_2)}{l_3}$$

Figure 9:
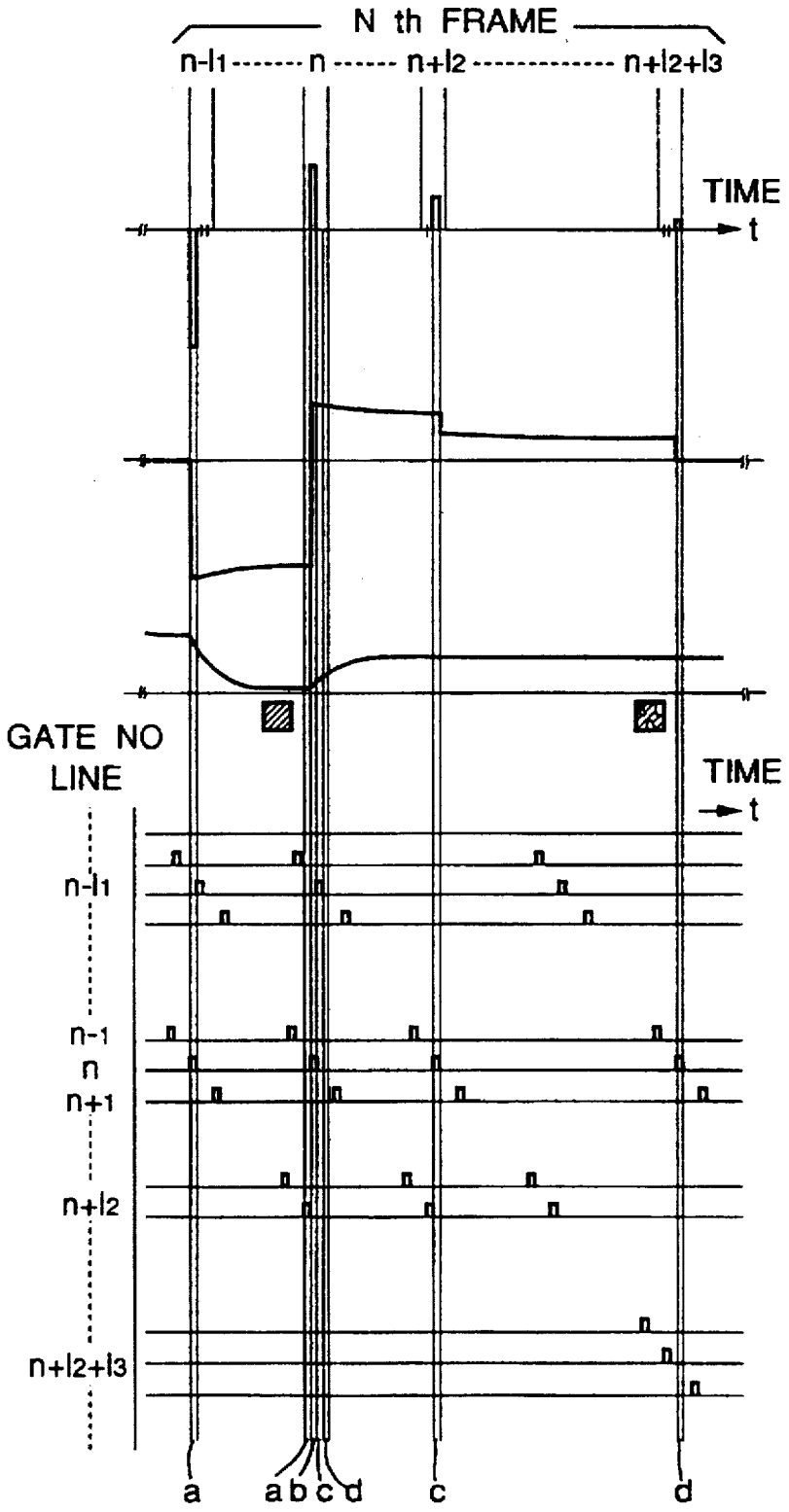
FIG. 9 is a timing chart showing an FLC driving method according to still another embodiment of the invention.
Figure 10:
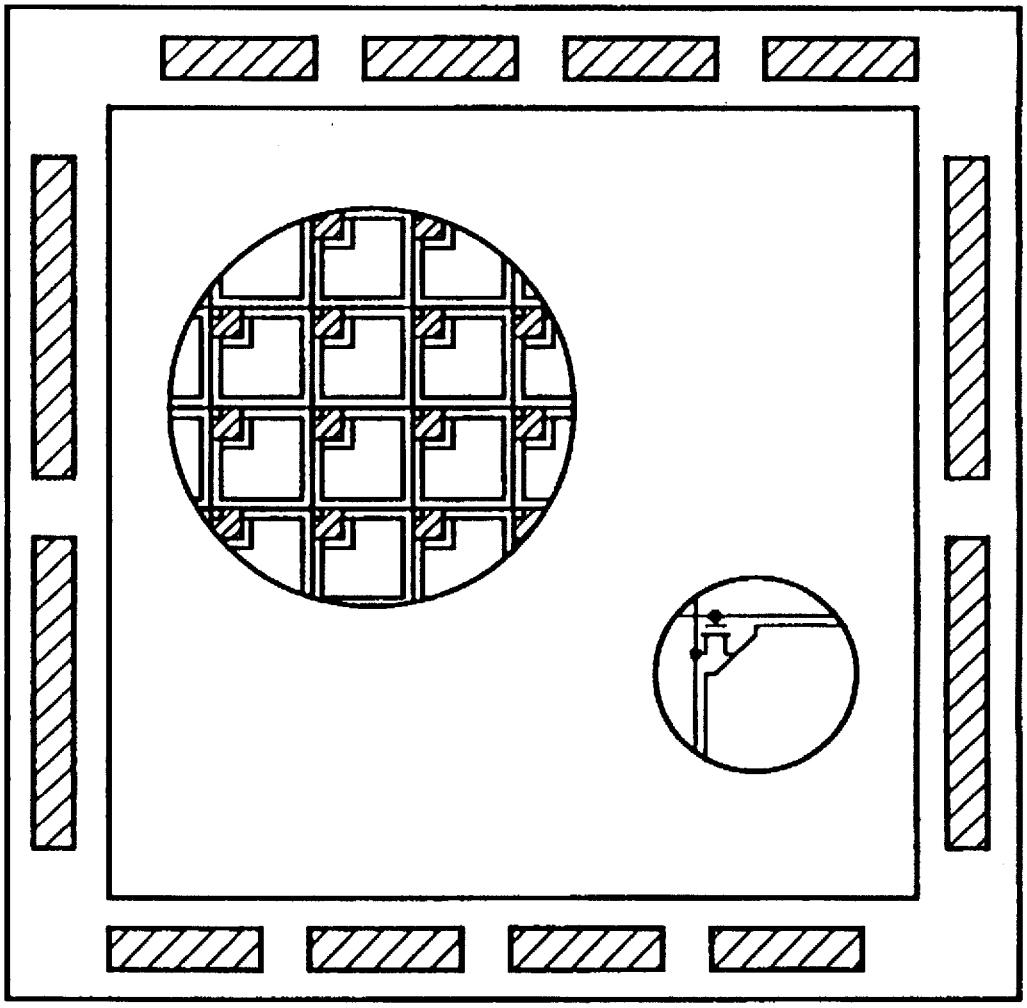
FIG. 10 is a constructional diagram of an active matrix liquid crystal device.

FIG. 9 shows a timing chart in the case where the above embodiment has been used. For instance, assuming that $l_3$=20, $l_1$=$l_2$=l=6, $V_0$ is set to 7 (V) in a manner similar to the foregoing embodiment, and $V_x$=5 (V), $V_{xx}$=12/20=0.6 (V). When it is assumed that a DC-manner threshold value of the liquid crystal which is used at this time is 2 V or more, even if the minimum voltage (whole "black" voltage) upon recording is set to 2 V, the auxiliary voltage $V_{xx}$ is equal to $$V_{xx} = \frac{(7\text{ V} - 2\text{ V}) \times 6}{20} + 1.5\text{ (V)}$$

and can be set to the threshold value or less.

It is sufficient to set the above DC-manner threshold value of the liquid crystal which is used into a value such as not to change a transmitting state by the supply of the DC voltage of a length of one frame (for example, about 30 msec) of, e.g., a TV signal as mentioned above.

Assuming that the threshold value is set to $V_{th}$, there is the following relation between the number $l_3$ of delay lines of the supply of the 0 (earth or grounding) voltage signal and the $l_1$ and $l_2$ or the $V_0$ and $V_x$.

$$V_{th} > V_{xx} = \frac{(V_0 \times l_1) - (V_x \times l_2)}{l_3}$$

Therefore, the driving method according to the invention preferably functions by selecting the number of delay lines such as $$l_3 > \frac{(V_0 \times l_1) - (V_x \times l_2)}{V_{th}}$$

In the embodiment, in FIG. 8, for instance, an earth (grounding) signal output circuit is further provided as an auxiliary signal circuit to a driving circuit shown in the diagram and is coupled to a signal synchronizing circuit as an input connection d.

The line intervals shown by $l_1$ and $l_2$ can be properly selected in accordance with the response speed of the material of the liquid crystal which is used. However, it is preferable to reduce such a line interval to a value near the upper limit of the response speed of the material so as not to cause a flicker or the like on the screen.

On the other hand, for instance, when the maximum values of the reset voltage, recording voltage, and the like are changed for an adjustment or the like of the whole "white" or whole "black" state or the like, even if the reset voltage applying time, the recording voltage applying time, and the like are set so as to slightly differ in both of the signal pulse and the substantial cell holding time, an effect similar to that mentioned above is not lost.

What is claimed is:

1. A method of driving an active matrix liquid crystal device, in which the device incorporates a liquid crystal having a memory performance and is line scan sequentially driven with an access time for accessing the pixels of each line of the device, said method comprising the steps of:

applying a first scanning pulse in a reset interval in a first vertical scanning operation to provide a reset voltage signal for resetting each pixel on a first selected line;

applying a second scanning pulse in a recording interval in a second vertical scanning operation to provide a recording voltage signal for writing each pixel on a second selected line; and applying a third scanning pulse in a further interval in a third vertical scanning operation to provide a further voltage signal, whose level is equal to or less than an optical threshold value of the liquid crystal, to each pixel on a third selected line, wherein the first, second and third selected lines in each of said reset interval, said recording interval and said further interval are spaced at a predetermined number of lines from each other, and wherein a sum of time integrated values of the voltage signals which are applied to the pixels is equal to almost zero.

2. A method according to claim 1, wherein the liquid crystal is a ferroelectric liquid crystal.

3. A method according to claim 1, wherein said further voltage signal is a grounding signal.

4. A method according to claim 1, wherein said reset, recording and further intervals are continuous with each other.

5. A method according to claim 1, wherein the device comprises a TFT device.

6. A method according to claim 1, wherein polarities of said reset voltage signal and said recording voltage signal are different from each other.

7. A method according to claim 1, wherein said recording voltage signal comprises a gradient voltage.

8. A method according to claim 1, wherein said access time is set in an order of said reset, recording and further intervals.

9. A method according to claim 1, wherein said access time is set in an order of said reset, further and recording intervals.

10. A method according to claim 1, wherein said access time is set in order of said recording, reset and further intervals.

11. A method according to claim 1, wherein said access time is set in order of said recording, further and reset intervals.

12. A method according to claim 1, wherein said access time is set in an order of further, reset and recording intervals.

13. A method according to claim 1, wherein said access time is set in an order of said further, recording and reset intervals.

* * * * *

UNITED STATES PATENT AND TRADEMARK OFFICE

CERTIFICATE OF CORRECTION

PATENT NO. : 5,675,351

DATED : October 7, 1997

INVENTOR(S) : SHUZO KANEKO, ET AL.

It is certified that error appears in the above-identified patent and that said Letters Patent is hereby corrected as shown below:

IN THE DRAWINGS

Sheet 8 of 10, Fig. 8, "PANNEL" should read --PANEL--.

COLUMN 2

Line 11, "the a" should read --is the--;
Line 32, "pixel" should read --pixel,--; and
Line 47, "Optical" should read --optical--.

COLUMN 3

Line 47, "sum the" should read --sum of the--.

COLUMN 4

Line 17, "characteristics" should read --opening characteristics--;
Line 20, "cause" should read --to cause--;
Line 56, "sows" should read --shows--; and
Line 61, "upward" should read --is upward--.

Signed and Sealed this

Thirty-first Day of March, 1998

*Attest:*

Bruce Lehman

BRUCE LEHMAN

*Attesting Officer*

*Commissioner of Patents and Trademarks*